US008522689B2

(12) United States Patent
Beck

(10) Patent No.: US 8,522,689 B2
(45) Date of Patent: Sep. 3, 2013

(54) CABLE RAILWAY SYSTEM

(75) Inventor: Markus Beck, Fussach (AT)

(73) Assignee: Innova Patent GmbH, Wolfurt (AT)

( * ) Notice: Subject to any disclaimer, the term of this patent is extended or adjusted under 35 U.S.C. 154(b) by 162 days.

(21) Appl. No.: 13/161,025

(22) Filed: Jun. 15, 2011

(65) Prior Publication Data

US 2012/0042803 A1 Feb. 23, 2012

(30) Foreign Application Priority Data

Aug. 19, 2010 (AT) ..... A 1390/2010

(51) Int. Cl.
*B61B 7/00* (2006.01)
*B61B 9/00* (2006.01)

(52) U.S. Cl.
USPC ..... 104/112; 104/173.1

(58) Field of Classification Search
USPC ..... 104/89–91, 112–115, 173.1, 173.2
See application file for complete search history.

(56) References Cited

U.S. PATENT DOCUMENTS 4,641,584 A * 2/1987 Bertrand ..... 104/173.2
4,699,064 A * 10/1987 Tarassoff ..... 104/163
5,119,733 A * 6/1992 Brochand ..... 104/112

* cited by examiner

*Primary Examiner* — R. J. McCarry, Jr.
(74) *Attorney, Agent, or Firm* — Laurence A. Greenberg; Werner H. Stemer; Ralph E. Locher

(57) ABSTRACT

A cableway system has a conveying cable that is guided via a head wheel pulleys in the two terminal stations of the system. Vehicles, such as gondolas or chairs, are coupled to the conveying cable between stations, and they are guided through the stations by way of travelling-gear mechanisms. In the stations, the vehicles are moved by way of tire wheels or control tires, and the tire wheels are driven by at least one supporting roller for the conveying cable. The supporting roller is located in the relevant station. The at least one of these supporting rollers for the conveying cable via which the drive power of the control tires is derived from the conveying cable is adjustable in the vertical direction.

11 Claims, 6 Drawing Sheets

CABLE RAILWAY SYSTEM

CROSS-REFERENCE TO RELATED APPLICATION

This application claims the priority, under 35 U.S.C. §119, of Austrian patent application A 1390/2010, filed Aug. 19, 2010; the prior application is herewith incorporated by reference in its entirety.

BACKGROUND OF THE INVENTION

Field of the Invention

The present invention relates to a cableway system having a conveying cable, which is guided via a deflecting pulley in each case in the two terminal stations of the system, and having vehicles, such as cars or chairs, which can be coupled to the conveying cable and are designed with a clamping device and with a travelling-gear mechanism, wherein they are coupled to the conveying cable along the path of the cableway system and are uncoupled from the conveying cable at the entrance into the stations, are guided through the stations, along guide rails, by way of the travelling-gear mechanism. There, the passengers disembark from the vehicles and board the vehicles. Then the vehicles are once more coupled to the conveying cable at the exit from the stations. The vehicles are moved in the stations by means of control tires, namely decelerating tires, conveying tires and accelerating tires, which are coupled to one another for carrying-along action by gear mechanisms, the speed of the vehicles, once uncoupled from the conveying cable, being reduced thereby by the decelerating tires, furthermore the vehicles being moved by means of the conveying tires at a low speed through the boarding and disembarking region for the passengers, the passengers boarding the vehicles and disembarking therefrom in this region, and the speed of the vehicles being increased by the accelerating tires, whereupon they are then coupled to the conveying cable again and conveyed out of the station. The control tires are driven by the conveying cable via at least one supporting roller for the conveying cable, the supporting roller being located in the relevant station.

In the case of such cableway systems in which the drive power for the control tires is derived from the conveying cable via at least one supporting roller for the conveying cable, the at least one supporting roller is mounted on a spindle which is fastened rigidly on the load-bearing structure. However, the vertical movements of the conveying cable give rise to this at least one supporting roller being subjected to different degrees of loading, which result in increased wear to this at least one supporting roller. Furthermore, as a result, vibration and impact caused by the conveying cable pass into the load-bearing structure of the station, for which reason the load-bearing structure has to be of correspondingly reinforced design.

SUMMARY OF THE INVENTION

It is accordingly an object of the invention to provide a cableway system which overcome the above-mentioned disadvantages of the heretofore-known devices and methods of this general type and which provides for a system that has reduce to a significant extent the loading, vibration and impact which pass to the load-bearing structure by way of the conveying cable via that at least one supporting roller from which the drive power for the tire wheels is derived.

With the foregoing and other objects in view there is provided, in accordance with the invention, a cableway system, comprising:

a conveying cable extending between and guided about deflecting pulleys in two terminal stations of the system;

vehicles formed with a coupling device for coupling the vehicles to the conveying cable and with a travelling-gear mechanism, wherein the vehicles are coupled to the conveying cable along a path of the cableway system, uncoupled from the conveying cable at an entrance into the respective station, guided through the station along guide rails by way of the travelling-gear mechanisms, whereupon passengers disembark from and board the vehicles, and wherein the vehicles are coupled once more to the conveying cable at an exit from the respective station;

a plurality of tire wheels connected to one another and disposed to move the vehicles through the stations, the tire wheels including decelerating tires, conveying tires, and accelerating tires, wherein a speed of the vehicles, after uncoupling from the conveying cable, is reduced by the decelerating tires from a higher speed to a lower speed, the vehicles are moved by the conveying tires at the lower speed through a disembarking and boarding region at which passengers disembark from and board the vehicles, and the speed of the vehicles is increased from the lower speed to the higher speed by the accelerating tires, whereupon the vehicles are once more coupled to the conveying cable and conveyed away from the station; and at least one supporting roller disposed to support the conveying cable in the station and connected to drive the tire wheels by transmitting drive power from the conveying cable to the tire wheels, the at least one supporting roller being mounted for adjustment in the vertical direction.

In other words, the objects of the invention are achieved in that the at least one of those supporting rollers for the conveying cable via which the drive power of the control tires is derived from the conveying cable can be adjusted in the vertical direction. The at least one supporting roller, via which the tire wheels are driven, is preferably mounted on at least one pivotally mounted rocker or the like.

A further embodiment provides for two rockers, on which are mounted in each case two supporting rollers, which are coupled to one of the control tires for carrying-along action in each case via a drive belt. It is also possible to provide a rocker, with in each case one rocker for in each case two supporting rollers mounted at its ends, wherein at least one of these two pairs of supporting rollers is coupled to a control tire for carrying-along action via a drive belt. In addition, it is possible to provide a first rocker on which are mounted, on the one hand, at least one supporting roller for the conveying cable and, on the other hand, a second rocker with two pairs of supporting rollers, wherein at least one of the two pairs of supporting rollers is coupled to at least one control tire for carrying-along action via a drive belt.

According to a further embodiment, at least two supporting rollers may be mounted each at one end of a one-armed rocker, and each of these rockers is designed with a restoring spring which acts counter to the loading by the conveying cable.

Furthermore, the control tires may be subdivided into at least two groups which are not coupled to one another for carrying-along action, which two groups are driven by associated supporting rollers for the conveying cable. In addition, the control tires, or the individual groups of control tires, may be driven by in each case a plurality of vertically adjustable supporting rollers for the conveying cable.

Other features which are considered as characteristic for the invention are set forth in the appended claims.

Although the invention is illustrated and described herein as embodied in a cable railway system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
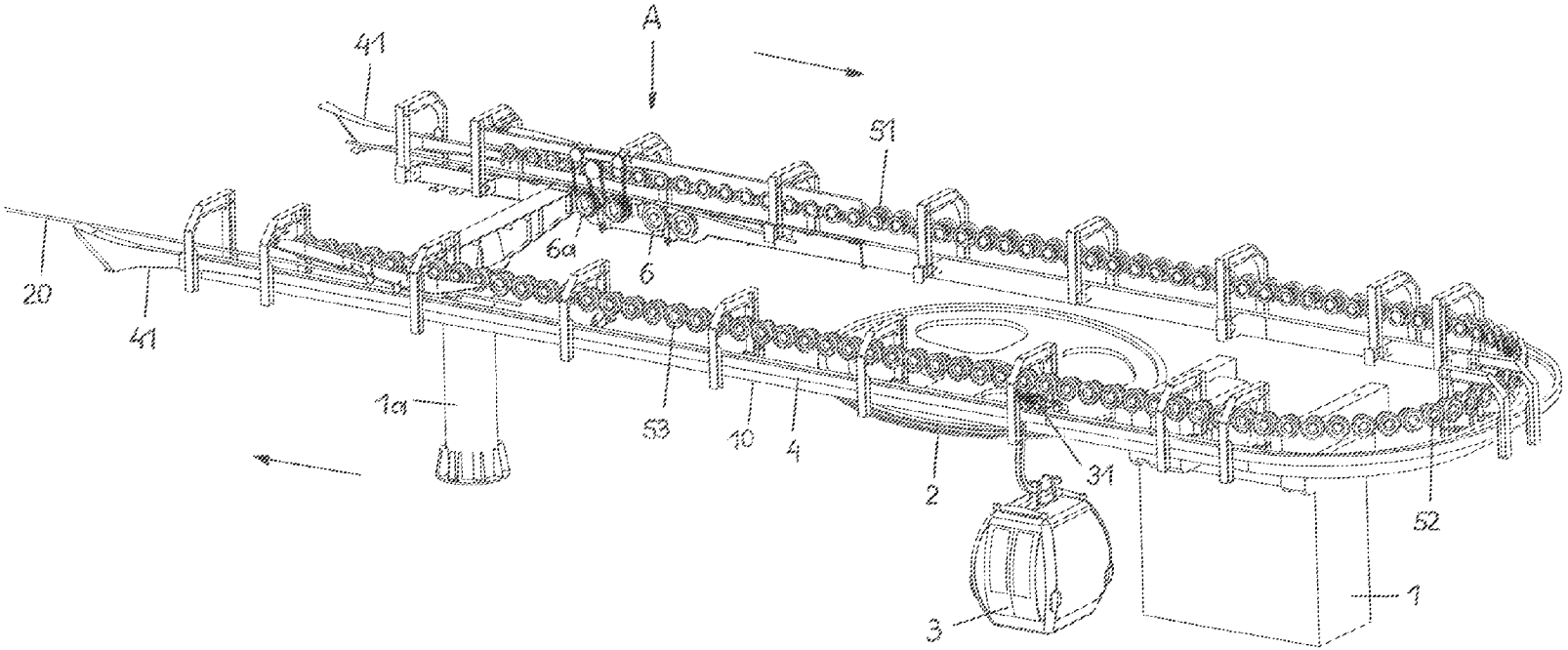
FIG. 1 is a perspective view of one of the terminal stations in a cableway system according to the invention.

Referring now to the figures of the drawing in detail and first, particularly, to FIG. 1 thereof, there is shown a terminal station with a load-bearing structure 10 which is borne by columns 1 and 1*a*. A reversing or deflecting pulley 2, also referred to as a head wheel 2, for guiding a conveying cable 20, is mounted on a more or less vertical axis. During operation of the cableway system, the conveying cable 20 is moved in circulation at a speed of, for example, 6 m/sec by a drive motor which, in a preferred implementation, is located in the mountain station. Vehicles 3, in the present case gondolas or cabins, or multi-person chairs, and the like, can be coupled to the conveying cable 20. The vehicles 3 are coupled to the conveying cable 20 along the path of the cableway system. The vehicles 3 are uncoupled from the conveying cable 20 at the entrance into the station and moved through the station, along a guide rail 4, by means of a travelling-gear mechanism 31. The vehicles 3 are once more coupled to the conveying cable 20 at the exit from the station. The guide rail 4 is designed with introduction means 41 at its two free ends. The movement direction of the vehicles 3 is indicated by arrows.

For the purpose of moving the vehicles 3 through the station, use is made of tire-clad wheels, which are referred to as control tires or tire wheels 51, 52 and 53. They are mounted on the load-bearing structure 10 and are coupled to one another for carrying-along action, or slave-along drive connection, via gear mechanisms. The tire wheels 51 of a first group, which are located at the entrance into the station, serve as decelerating tires, by means of which the speed of the vehicles 3, at this time uncoupled from the conveying cable 20, is reduced from, say, 6 m/sec to, for example, 0.3 m/sec. The following control tires 52 of a second group are conveying tires, by means of which the vehicles 3 are guided at the speed of, for example, 0.3 m/sec through the boarding and disembarking region of the station, in which the passengers disembark from the vehicle and board the vehicles. The third group of control tires 53, which serve as accelerating tires, increases the speed of the vehicles 3 up to the speed of the conveying cable, for example, 6 m/sec, whereupon the vehicles 3, at the exit from the station, are coupled to the conveying cable 20, which circulates at this speed.

The conveying cable 20 is guided via a multiplicity of supporting rollers 6, which are mounted on the load-bearing structure 10 and are rotated by the conveying cable 20. The control tires 51, 52 and 53 are driven in that they are coupled for rotation to at least one supporting roller 6 for the conveying cable 20. The spindle of the at least one supporting roller 6 from which the drive power is derived is rigidly mounted in the prior art systems, while the remaining supporting rollers 6 are non-rigidly supported, for example on rockers.

Figure 2:
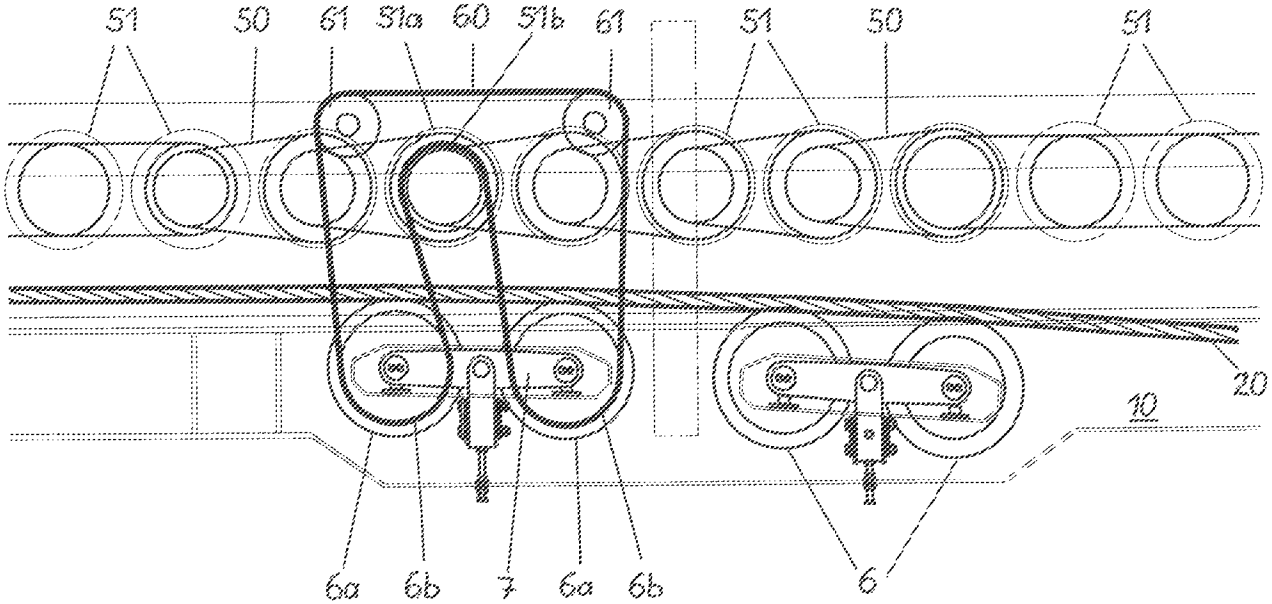
FIG. 2 is an elevation view of a first embodiment of detail A shown in FIG. 1, illustrated on an enlarged scale relative to FIG. 1.

As can be seen from FIG. 2, the supporting rollers 6 are mounted on rockers 7. In the case of the cableway system according to the invention, the spindle of the at least one supporting roller 6 for the conveying cable 20, via which the drive power for the control tires 51, 52 and 53 is derived from the conveying cable 20, is not fastened rigidly on the load-bearing structure 10, as is the case according to the prior art. Rather, the load-bearing structure 10 has mounted on it a rocker 7 with in each case one supporting roller 6*a* for the conveying cable 20 mounted at its two ends, wherein these two supporting rollers 6*a* are each designed with belt surfaces 6*b* for a drive belt 60. Two deflecting rollers 61 for the drive belt 60 are also mounted on the load-bearing structure 10. In addition, one of the control tires 51*a* is designed with a belt surface 51*b* for the drive belt 60. By means of the drive belt 60, which is positioned over the belt surfaces 6*b* of the supporting rollers 6*a* for the conveying cable 20, the deflecting rollers 61 and the belt surface 51*b* of the control tire 51*a*, the drive power for the control tire 51*a* and for the further control tires 51, 52 and 53, which are coupled to the control tire 51*a* for carrying-along action via belt gear mechanisms 50, is derived from the conveying cable 20 via the two supporting rollers 6*a* for the latter mounted on the rocker 7.

The individual control tires 51, 52 and 53 are coupled to one another by means of the belts 50 such that they have increasing or decreasing rotational speeds.

Since the two supporting rollers 6*a* are located on the rocker 7, on the one hand these two supporting rollers 6*a* are subjected to much more uniform loading, by the vibration and vertical movements exerted by the conveying cable 20, than is the case with supporting rollers mounted on rigid spindles. On the other hand, the load-bearing structure 10 is thereby subjected to considerably lower levels of vibration and impact than is the case with supporting rollers for the conveying cable 20 which are mounted on rigid spindles.

As is illustrated in FIG. 1, the cableway station has provided in it a single rocker 7 via which the drive power of the control tires 51, 52 and 53 is derived from the conveying cable 20. However, it is also possible for the control tires 51, 52 and 53 to be driven by way of the conveying cable 20 via a plurality of rockers 7 or groups of rockers 7. For this purpose, the control tires 51, 52 and 53 may be subdivided into groups which are driven in each case via separate rockers 7 or groups of rockers 7. Since this drive system is inherently elastic, it is also possible for all the control tires 51, 52 and 53 to be coupled to one another for carrying-along action.

Figure 3:
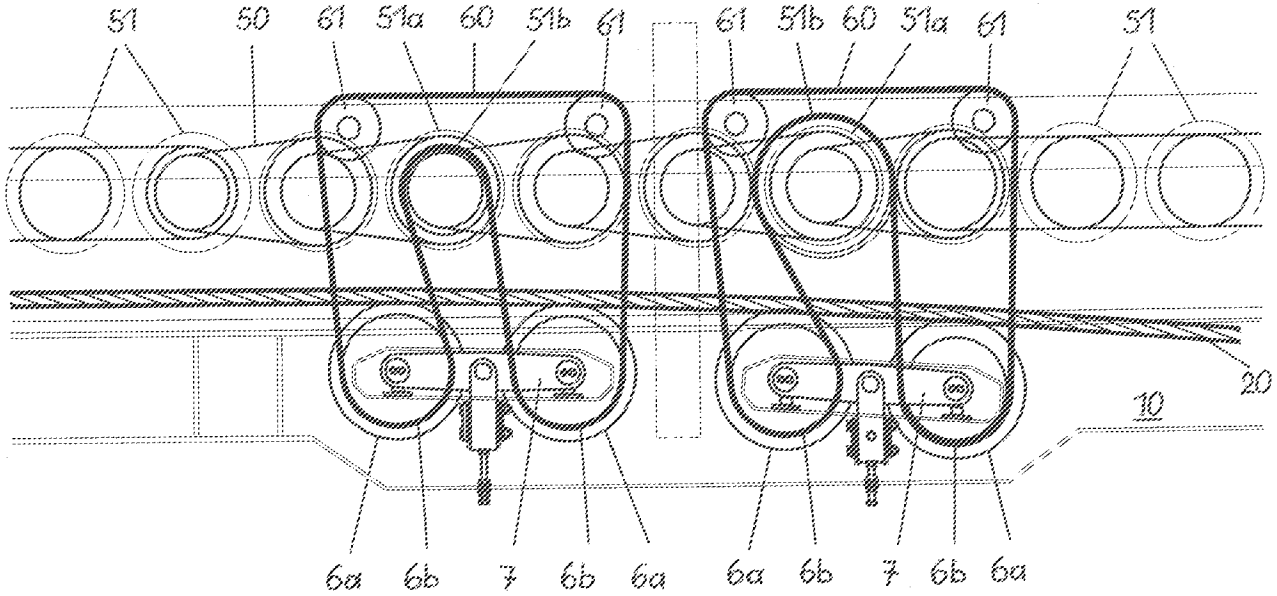
FIG. 3 is an elevation view of a second embodiment of the detail A in FIG. 1, again illustrated on an enlarged scale relative to FIG. 1.

The second embodiment, which is illustrated in FIG. 3, differs from the embodiment according to FIG. 2 by the provision of two rockers 7, on which are mounted in each case two supporting rollers 6*a*, which are coupled to control tires 51*a* for carrying-along action by means of drive belts 60, which are positioned over belt surfaces 6*b* of the supporting rollers 6*a*. In order to allow for successive control tires 51*a* having different, that is to say increasing or decreasing, rotational speeds, the belt surfaces 51*b* of successive control tires 51*a* have to have different diameters.

It is also the case with this embodiment that the supporting rollers 6*a* for the conveying cable 20, from which the drive power for the control tires 51, 52 and 53 is derived, can be adjusted vertically by virtue of being mounted on the rocker 7, as a result of which they are loaded uniformly by the conveying cable 20 and only low levels of vibration and impact pass into the load-bearing structure 10.

Figure 4:
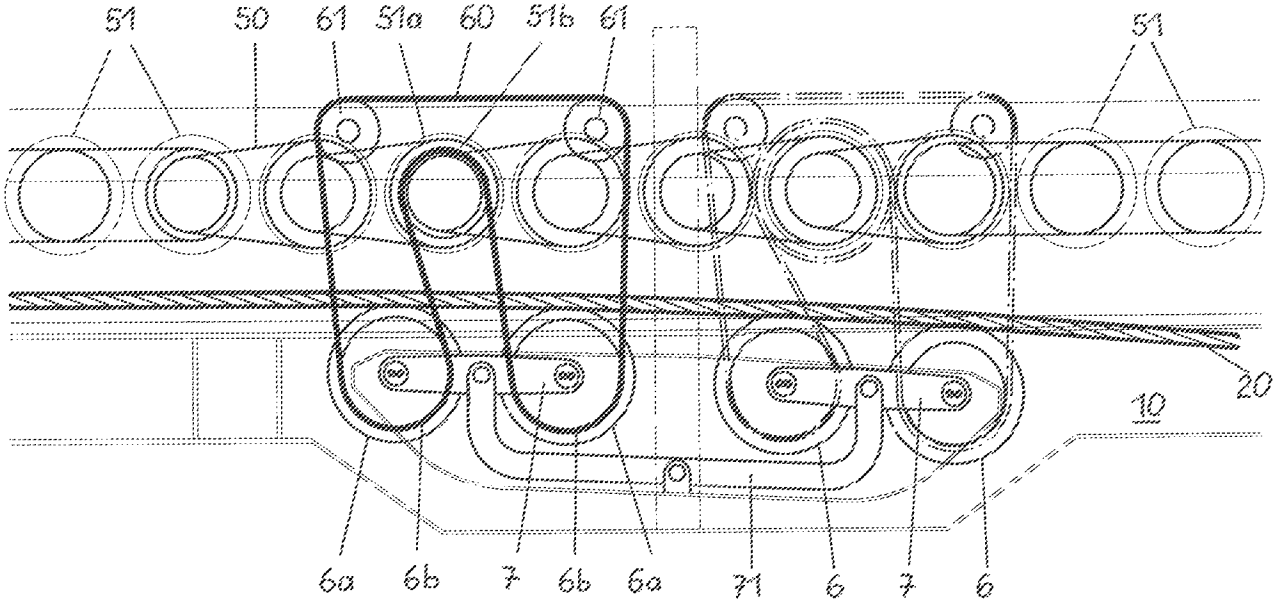
FIG. 4 is an elevation view of a third embodiment of the detail A in FIG. 1, again illustrated on an enlarged scale relative to FIG. 1.

The third embodiment, which is illustrated in FIG. 4, differs from the embodiment according to FIG. 3 in that the rocker 7 is pivotally mounted at one end of a further rocker 71, which has a rocker 7 for two supporting rollers 6 pivotally mounted at its other end. It is possible here for the supporting rollers 6 to serve exclusively as supporting rollers for the conveying cable 20 or for a further drive belt for the control tires 51, 52 and 53 to be positioned over these supporting rollers.

Figure 5:
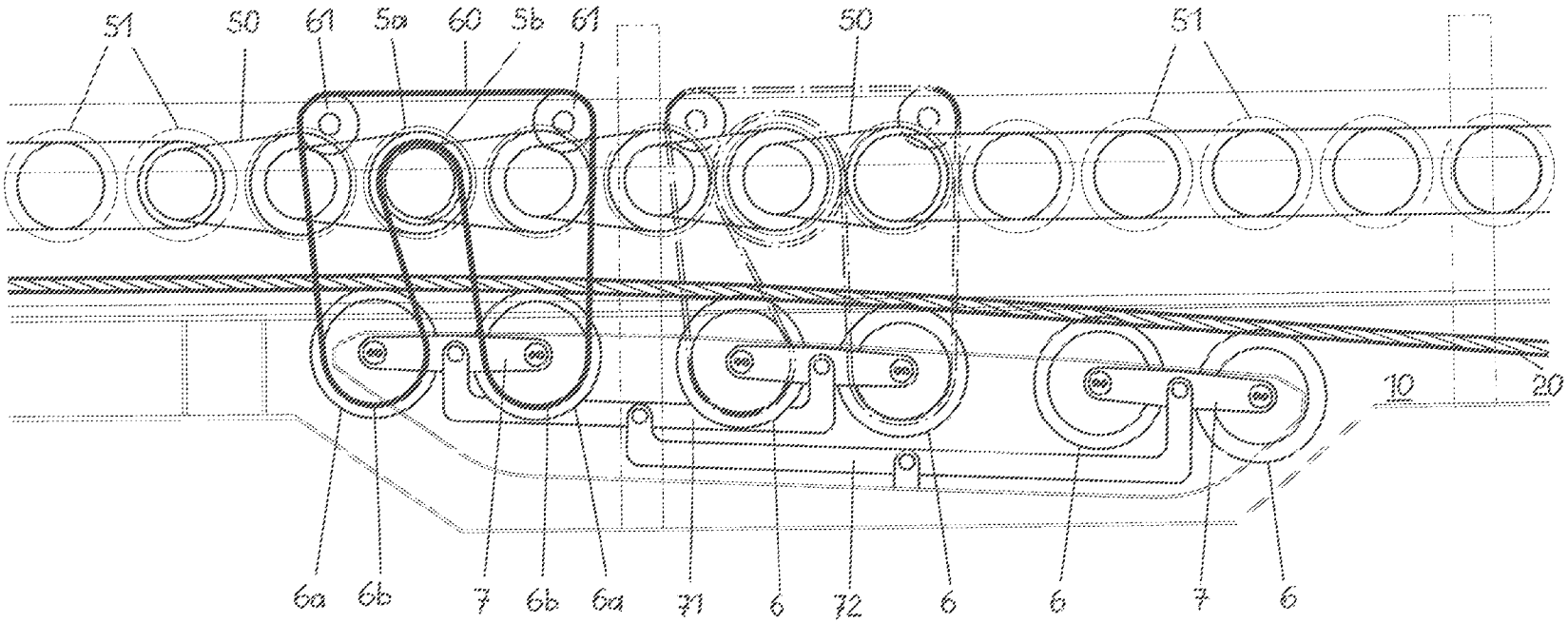
FIG. 5 is an elevation view of a fourth embodiment of the detail A in FIG. 1, again illustrated on an enlarged scale relative to FIG. 1.

The fourth embodiment, which is illustrated in FIG. 5, differs from the embodiment according to FIG. 4 in that the rocker 71 is mounted on a further rocker 72, which has two supporting rollers 6 for the conveying cable 20 mounted at its other end.

Figure 6:
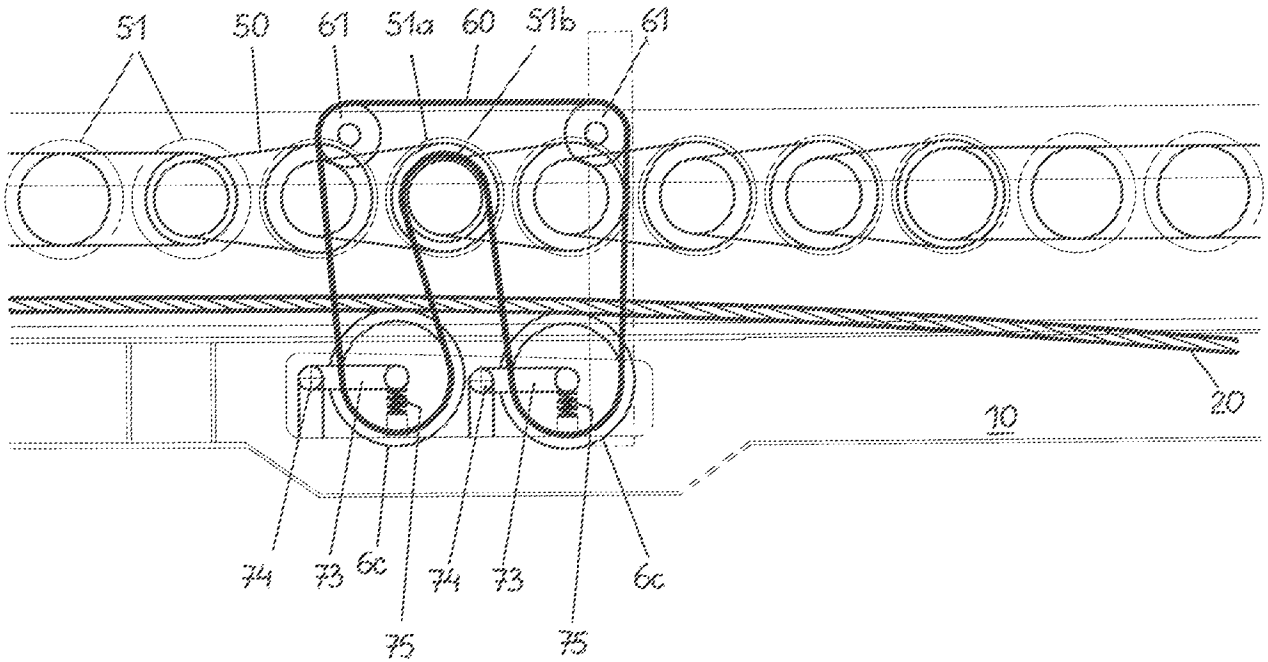
FIG. 6 is an elevation view of a fifth embodiment of the detail A in FIG. 1, again illustrated on an enlarged scale relative to FIG. 1.

In the case of the fifth embodiment, which is illustrated in FIG. 6, in each case one supporting roller 6*c* is mounted at one end of a one-armed rocker 73, the other end of which is mounted on a framework-mounted bolt 74, wherein the rocker 73 is subjected to the action in each case of at least one adjusting spring 75.

Due to the fact that the axes of rotation even of those supporting rollers 6*a* for the conveying cable 20 of the cableway system which are coupled to the control tires 51, 52 and 53, via drive belts 60, for movement of the vehicles 3 through the station can be adjusted vertically, all of these design ensure that these supporting rollers 6*a* are loaded uniformly by the conveying cable 20, and that the situation where vibration and impact caused by the conveying cable 20 is transmitted to the load-bearing structure 10 is largely avoided.

The vehicles of such a cableway system can be used both for transporting people and for transporting goods.

The invention claimed is:

1. A cableway system, comprising:

a conveying cable extending between and guided about deflecting pulleys in two terminal stations of the system;

vehicles formed with a coupling device for coupling the vehicles to said conveying cable and with a travelling-gear mechanism, wherein said vehicles are coupled to said conveying cable along a path of the cableway system, uncoupled from said conveying cable at an entrance into the respective station, guided through the station along guide rails by way of the travelling-gear mechanisms, whereupon passengers disembark from and board said vehicles, and wherein said vehicles are coupled once more to said conveying cable at an exit from the respective station;

a plurality of tire wheels connected to one another and disposed to move said vehicles through the stations, said tire wheels including decelerating tires, conveying tires, and accelerating tires, wherein a speed of said vehicles, after uncoupling from said conveying cable, is reduced by said decelerating tires from a higher speed to a lower speed, said vehicles are moved by said conveying tires at the lower speed through a disembarking and boarding region at which passengers disembark from and board said vehicles, and the speed of said vehicles is increased from the lower speed to the higher speed by said accelerating tires, whereupon said vehicles are once more coupled to said conveying cable and conveyed away from the station; and at least one supporting roller disposed to support said conveying cable in the station and connected to drive said tire wheels by transferring a drive power from said conveying cable to said tire wheels, said at least one supporting roller being mounted for adjustment in the vertical direction.

2. The cableway system according to claim 1, which comprises a carry-along transmission system drivingly connecting said plurality of tire wheels to one another.

3. The cableway system according to claim 1, which comprises at least one pivotally mounted rocker carrying said at least one supporting roller, via which said tire wheels are driven.

4. The cableway system according to claim 1, which comprises two rockers each carrying two said supporting rollers, and a drive belt coupling each of said supporting rollers to said tire wheels in a slave-along drive connection.

5. The cableway system according to claim 1, which comprises a rocker formed with two ends each carrying a further rocker, and each further rocker carrying a respective pair of said supporting rollers, and a drive belt coupling at least one of said two pairs of supporting rollers to a tire wheel with a slave-along drive connection.

6. The cableway system according to claim 1, which comprises a first rocker carrying, on the one hand, at least one said supporting roller for said conveying cable and, on the other hand, a second rocker carrying two pairs of said supporting rollers for said conveying cable, and a drive belt coupling at least one of said two pairs of supporting rollers to at least one said tire wheel with a slave-along drive connection.

7. The cableway system according to claim 1, which comprises two one-armed rockers each having an end with at least one said supporting roller mounted thereon, and a restoring spring associated with each of said one-armed rockers for counter-acting a loading force of said conveying cable on said supporting rollers.

8. The cableway system according to claim 1, wherein said tire wheels are subdivided into at least two groups that are not coupled to one another in a slave-along drive connection, and wherein said at least two groups are driven by respectively associated said supporting rollers for said conveying cable.

9. The cableway system according to claim 8, wherein said at least one support roller is one of a plurality of support rollers for said conveying cable, and said tire wheels, or individual groups of said tire wheels, are driven by in each case a plurality of vertically adjustable said supporting rollers.

10. The cableway system according to claim 1, wherein said at least one supporting roller is rotatably mounted about a substantially horizontal axis and said conveying cable is supported on said at least one supporting roller.

11. A cableway system, comprising:

a conveying cable extending between and guided about deflecting pulleys in two terminal stations of the system;

vehicles formed with a coupling device for coupling the vehicles to said conveying cable and with a travelling-gear mechanism, wherein said vehicles are coupled to said conveying cable along a path of the cableway system, uncoupled from said conveying cable at an entrance into the respective station, guided through the station along guide rails by way of the travelling-gear mechanisms, whereupon passengers disembark from and board said vehicles, and wherein said vehicles are coupled once more to said conveying cable at an exit from the respective station;

a plurality of tire wheels connected to one another and disposed to move said vehicles through the stations, said tire wheels including decelerating tires, conveying tires, and accelerating tires, wherein a speed of said vehicles, after uncoupling from said conveying cable, is reduced by said decelerating tires from a higher speed to a lower speed for traversing the station and the speed of said vehicles is increased from the lower speed to the higher speed by said accelerating tires, whereupon said vehicles are once more coupled to said conveying cable and conveyed away from the station; and at least one supporting roller disposed in the station and driven by said conveying cable by frictional engagement therewith and connected to drive said tire wheels by transferring a drive power from said conveying cable to said tire wheels, said at least one supporting roller being mounted to reduce a transfer of vibrations of said conveying cable to a load-bearing structure of the station.

* * * * *